US006568318B2

(12) United States Patent
Kurtz

(10) Patent No.: US 6,568,318 B2
(45) Date of Patent: May 27, 2003

(54) PROCESS FOR OPERATING A CALENDER AND CALENDER

(75) Inventor: Rüdiger Kurtz, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/907,641

(22) Filed: Jul. 19, 2001

(65) Prior Publication Data

US 2002/0014165 A1 Feb. 7, 2002

(30) Foreign Application Priority Data

Aug. 3, 2000 (DE) ..... 100 37 835

(51) Int. Cl.[7] ..... B30B 13/00
(52) U.S. Cl. ..... 100/35; 100/70 R; 100/155 R
(58) Field of Search ..... 100/35, 162 R, 100/161, 155 R, 70 R, 73; 72/236; D21G 1/00, 1/02; B30B 3/04

(56) References Cited

U.S. PATENT DOCUMENTS 1,864,852 A * 6/1932 Oblinger ..... 101/132
5,122,232 A * 6/1992 Lyman et al. ..... 100/332
5,237,915 A * 8/1993 Rounsley ..... 100/161
5,522,312 A * 6/1996 Johnson ..... 100/102
5,649,478 A * 7/1997 Chadha ..... 100/162 R
5,655,444 A 8/1997 Kayser et al. ..... 100/334
6,073,548 A * 6/2000 Kayser et al. ..... 100/155 R
6,104,906 A * 8/2000 Horikoshi ..... 399/326

FOREIGN PATENT DOCUMENTS

| | | |
|---|---|---|
| DE | 1481VII/55e | 6/1956 |
| DE | 19506301 | 8/1996 |
| DE | 19925419 | 12/2000 |
| DE | 19925420 | 12/2000 |
| WO | 99/36616 | 7/1999 |

* cited by examiner

*Primary Examiner*—Allen Ostrager
*Assistant Examiner*—Jimmy T Nguyen
(74) *Attorney, Agent, or Firm*—Greenblum & Bernstein, P.L.C.

(57) ABSTRACT

Process for operating a calender and a calender. The calender includes a hard roll and a soft roll with an elastic surface, in which the hard roll and the soft roll are arranged to form at least one nip, and a finishing medium application device positioned adjacent the soft roll. The process includes providing a finish on the elastic surface of the soft roll.

42 Claims, 1 Drawing Sheet

PROCESS FOR OPERATING A CALENDER AND CALENDER

CROSS-REFERENCE TO RELATED APPLICATIONS

The present application claims priority under 35 U.S.C. §119 of German Patent Application No. 100 37 835.8, filed on Aug. 3, 2000, the disclosure of which is expressly incorporated by reference herein in its entirety.

BACKGROUND OF THE INVENTION

1. Field of the Invention

The present invention relates to a process for operating a calender with at least one nip that is formed by a hard roll and a soft roll with an elastic surface. The invention further relates to a calender with at least one nip that is formed by a hard roll and a soft roll with an elastic surface.

2. Discussion of Background Information

Such calenders are used for subjecting a material web passing through the nip to increased pressure and optionally to an increased temperature as well. In this regard, a compression of the material web occurs and it is possible to influence certain surface properties such as gloss and smoothness by treatment in a nip.

In order to explain the invention, a paper web will be used in the following as an example of a material web. The calendering of a paper web is also the primary application of the invention. However, the invention may also be used with other material webs that are treated in a similar manner.

A nip that is formed by a hard roll and a soft roll with an elastic surface is also referred to as a "soft" nip. Because of the different properties of the two rolls forming the nip, different surfaces generally result on both sides of the paper web after it has passed through the soft nip. The side that was in contact with the hard roll has a very smooth surface. This has the condition that it is possible to provide the hard roll with a smooth surface. This is different in the case of the elastic roll, whose surface is currently primarily formed by a plastic coating. It is relatively difficult to provide the plastic with the desired smoothness. As a rule, the surface roughness of the plastic is much greater than the surface roughness of the hard roll.

It is known from DE 195 06 301 A1 to form the plastic coating of the soft roll in two layers, with the outer layer having a lower elasticity and a greater hardness than the inner layer. For example, the outer layer can be composed of a silicon rubber. While the surface roughness of such a soft roll is relatively low when compared to other soft rolls, it is possible to discern distinct differences in the surface properties of the material web treated in the calender.

SUMMARY OF THE INVENTION

The present invention improves the quality of the material web.

Accordingly, the instant invention is directed to a process of the type mentioned at the outset which also includes the surface of the soft roll built into the calender is provided with a finish.

It is assumed that the surface roughness of the soft roll is caused by pores that form in the plastic. With the aid of the finish, these pores are filled and the roll surface is thus correspondingly made smooth. However, as in other finished surfaces, it can be observed that a roll treated in such a manner only remains smooth for a certain period of time. Obviously, therefore, the pores form again in operation, for example, in that the finish is removed again by a material web passing through. If the roll is then provided with the finish in its built-in state, it becomes possible to repeatedly or constantly apply a wear layer that allows the soft or elastic roll to be very smooth for a certain period of time. This smoothness of the soft roll has a very positive effect on gloss and smoothness of the material web passing through.

It is particularly preferred for a liquid finishing medium to be applied to the surface and dried. With the aid of a liquid finishing medium, an even coating of the surface of the roll with the finishing medium can be achieved relatively quickly. The term "liquid" used here may be interpreted broadly. It can also be a pasty medium that is only fluid in a limited sense. The finishing medium can also be sprayed on in the form of a sprayed mist. Finally, it is also possible for the finishing medium to be initially present in the form of steam and to condense on the surface of the soft roll. The step of drying is advisable in order to prevent the passing material web from being contaminated with the finishing medium. Moreover, a dried finishing medium adheres better to the surface.

It is preferred for the finishing medium to be applied to the surface while the surface is warm. The warmth accelerates the drying process. The roll is normally warm in operation anyway because the elastic roll is flexed during operation, thus producing warmth.

Preferably, the finish is polished. In the most simple case, this can be accomplished in that the roll is moved past a polishing device, for example, a textile cushion. This further improves the smoothness of the surface of the soft roll.

Preferably, the calender is stopped for maintenance purposes in maintenance pauses and the finish is applied outside of the maintenance pauses. In other words, the finishing medium can be applied during operation of the calender such that the surface finish can already be renewed before it has been worn off to the point that an increased roughness results.

It is preferred for the finish to be applied during interruptions in operation. While such interruptions in operation, for example, as a result of a tear in the paper web, are not desirable, they cannot always be prevented. In the case of such an interruption in operation, the calender must be stopped for a certain time anyway in order to remove the torn paper web, for example. This time can be used for applying finishing medium to the surface of the soft roll. However, removal of the roll is still not necessary.

Alternately or in addition to this, the finish can be continually applied. This achieves virtually constant conditions on the surface of the soft roll.

It is particularly preferred for the finish to be applied with the aid of a material web to be calendered in the nip. For example, the paper web can be provided with the finishing medium in such a way that the paper web deposits the finishing medium onto the surface of the soft roll. Of course, there must be compatibility between the paper and the finishing medium so that the quality of the paper web is not diminished.

Alternately or in addition to this, provision can also be made for the finish to be applied during the maintenance pauses. In the maintenance pauses, the calender is stopped, so that the finish can also be applied with the aid of humans without any danger.

More preferably, more than one soft roll is used and a predetermined number of the last soft rolls are provided with finish. This is particularly advantageous when the material web first runs through a calender such that one side only comes into contact with hard rolls, while this smoothed side then, as it passes through the rest of the calender, is pressed by the soft rolls. If these soft rolls are now provided with finish, the quality of this surface will no longer be made worse, but rather the quality will at least be able to be maintained.

The present invention is also directed to a calender of the type mentioned at the outset that also includes a finishing medium application device arranged at the soft roll. Using the finishing medium application device, it becomes possible to apply finishing medium even to a soft roll that is built into a calender for the purpose of making the surface of the soft roll extremely smooth. The application of the finishing medium can even occur during operation under certain conditions such that the surface can be maintained at a constant quality.

Preferably, the finishing medium application device has a dispenser for fluid or pasty finishing medium. The finishing medium can, for example, be sprayed on or applied in another manner. A finishing medium that is fluid in a wider sense can be used to attain an even coverage of the surface of the soft roll.

More preferably, the finishing medium application device has a smoothing device that follows the dispenser in the rotational direction of the roll. The finishing medium is then smoothed even further.

Preferably, several nips with hard and soft rolls as well as a changeover nip with two rolls of the same type are provided, with a finishing medium application device being provided at all soft rolls behind the changeover nip. The material web running through such a calender first comes into contact on one side with only hard, but extremely smooth rolls. The one side of the paper web is thus made very smooth. However, this side will come into contact with the soft rolls when it passes through the nips behind the changeover nip such that the glossiness or smoothness of this surface is again destroyed. If a finishing medium application device is assigned to all soft rolls behind the changeover nip, the surfaces of the soft rolls behind the changeover nip are kept so smooth that a decrease in quality of the surface is not to be anticipated.

The present invention is directed to a process for operating a calender, the calender having a hard roll and a soft roll with an elastic surface arranged to form at least one nip. The process includes providing a finish on the elastic surface of the soft roll.

In accordance with a feature of the instant invention, the finish can be provided by applying a liquid finishing medium to the elastic surface. Further, the finishing medium may be applied to the elastic surface while it is warm.

According to another feature of the present invention, the finish may be polished.

Moreover, operation of the calender includes maintenance pauses for the purpose of maintenance, and the finish is applied outside of the maintenance pauses. The finish can be applied during the maintenance pauses. Also, the finish can be continuously applied during operation of the calender. The finish may be applied via a material web to be calendered in the nip.

Still further, operation of the calender can include maintenance pauses for the purpose of maintenance, and the finish can be applied during maintenance pauses.

The calender may include a plurality of soft rolls and a predetermined number of the soft rolls are provided with a finish.

The calender can include a changeover nip formed by two similar type rolls, and the predetermined number of soft rolls can be arranged after the changeover nip relative to the web travel direction. The two similar type rolls may include two soft rolls.

The finish can be provided by spraying a finishing medium onto the elastic surface. The finishing medium may include a liquid silicon rubber. The finishing medium can include a hard wax containing polytetrafluoroethylene. Further, the finish provided on the elastic surface can form a more smooth surface than the elastic surface without the finish. The finishing medium may be compatible with the material web to avoid any decrease in web quality. The finishing medium can dry between an application point and a material web contact point.

The process may also include monitoring the finished elastic surface for wear, and, upon finding at least a certain amount of wear, refinishing the finished elastic surface.

The present invention is directed to a calender that includes a hard roll, and a soft roll with an elastic surface. The hard roll and the soft roll being arranged to form at least one nip, and a finishing medium application device is positioned adjacent the soft roll.

According to a feature of the invention, the finishing medium application device may include a dispenser for dispensing finishing media. The finishing media can be one of a liquid or a pasty medium.

In accordance with another feature of the instant invention, the finishing medium application device can include a smoothing device arranged to follow the dispenser in a rotational direction of the soft roll.

Further, the calender can include additional hard rolls, and additional soft rolls with elastic surfaces. The additional hard rolls and additional soft rolls may be arranged to form additional nips. At least two similar type rolls can be arranged to form a changeover nip, and additional finishing medium application devices can be positioned adjacent each soft roll located behind the changeover nip in a calendering direction. The at least two similar type rolls can be two soft rolls.

According to still another feature of the present invention, the finishing medium application device can include a nozzle for spraying finishing media onto the elastic surface. Further, the finishing media comprises a liquid silicon rubber. Still further, the finishing media can include a hard wax containing polytetrafluoroethylene. The finishing medium application device can be arranged to provide a finish on the elastic surface to form a more smooth surface than the elastic surface without the finish. The finishing media may be compatible with the material web to avoid any decrease in web quality. Further still, the finishing media can dry between an application point and a material web contact point.

In accordance with a further feature of the invention, a wear sensor can be arranged to monitor the finished elastic surface for wear. The wear sensor may be coupled to the finishing medium application device such that, upon finding at least a certain amount of wear, the finishing medium application device refinishes the finished elastic surface.

The present invention is directed to a calender that includes a first roll stack including at least one first hard roll and at least one first soft roll, and a second roll stack including at least one second hard roll and at least one second soft roll. The at least one first hard roll and the at least one first soft roll are arranged to form at least one first nip and the at least one second hard roll and the at least one second soft roll are arranged to form at least one second nip. At least two similar type rolls are arranged to form a changeover nip, and the changeover nip is positioned between the first roll stack and the second roll stack, such that the second roll stack is arranged after the first roll stack in a calendering direction. A finishing medium application device is arranged adjacent the at least one second soft roll.

In accordance with a feature of the present invention, the at least one second soft roll may include a plurality of second soft rolls, and a finishing medium application device can be arranged adjacent each of the plurality of second soft rolls.

The invention is directed to a process for operating a calender that includes a first roll stack including at least one first hard roll and at least one first soft roll, and a second roll stack including at least one second hard roll and at least one second soft roll. The at least one first hard roll and the at least one first soft roll are arranged to form at least one first nip and the at least one second hard roll and the at least one second soft roll are arranged to form at least one second nip. At least two similar type rolls are arranged to form a changeover nip, and the changeover nip is positioned between the first roll stack and the second roll stack, such that the second roll stack is arranged after the first roll stack in a calendering direction. The process includes applying finishing medium to a surface of the at least one second soft roll.

According to a feature of the instant invention, the process can also include smoothing the applied finishing medium.

In accordance with yet another feature of the present invention, the at least one second soft roll may include a plurality of second soft rolls, and the process can further include applying finishing medium to each of the plurality of second soft rolls. Moreover, the process can include smoothing the applied finishing medium on each of the plurality of second soft rolls.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
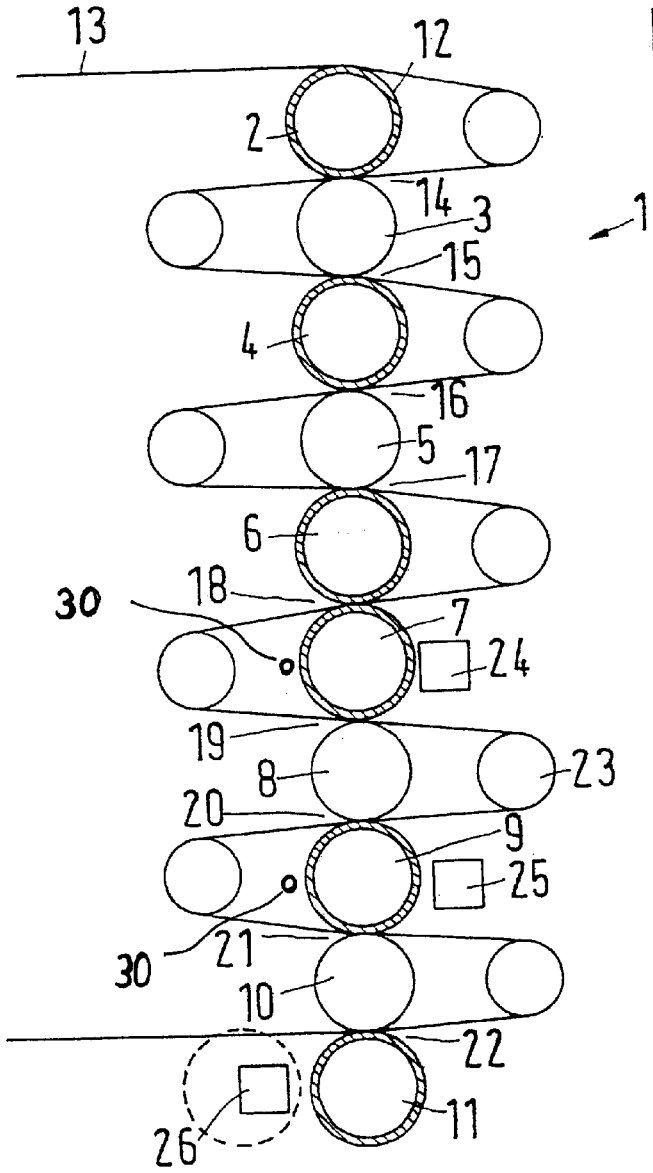
FIG. 1 schematically illustrates of a calender in accordance with the features of the invention.

FIG. 1 shows a calender 1 with ten rolls 2–11 which are arranged one above the other in a roll stack. The uppermost five rolls 2–6 form a first group and the lowermost five rolls 7–11 form a second group. The two groups can also be arranged next to one another. Rolls 2, 4, 6, 7, 9, and 11 are so-called "soft rolls," i.e., they have an elastic covering 12, while rolls 3, 5, 8, and 10 are embodied as so-called "hard rolls" whose surface is composed of a metal, e.g., steel. Hard rolls 3, 5, 8, and 10 have a very smooth surface.

A paper web 13 is now guided through nips 14–22, each of which is formed by two neighboring rolls, i.e., 2 and 3; 3 and 4; etc. Nips 14–17 and 19–22 are formed as so-called "soft nips," i.e., they are limited by one soft roll and one hard roll. In contrast, middle nip 18 formed as a so-called "changeover nip," i.e., it is formed by soft rolls 6 and 7.

Paper web 13 is also guided in the calender by guiding device, such as guide rolls 23, which are only shown schematically.

Paper web 13 is now guided into the nips formed between rolls 2–6 of the first group such that the surface of the web facing upwards upon entry into the calender only comes into contact with hard rolls 3 and 5. Thus, this upper side becomes very smooth. The smoothness of hard rolls 3 and 5 is replicated on the surface of the paper web.

However, after passing through changeover nip 18, this upper side comes into contact with soft rolls 7, 9, and 11 of the second group. As the surface of soft rolls 7, 9, and 11 normally has a significantly greater roughness than the surfaces of hard rolls 3, 5, 8, and 10, the relatively smooth upper side of paper web 13 tends to be degraded, i.e., lose its smoothness.

Figure 2:
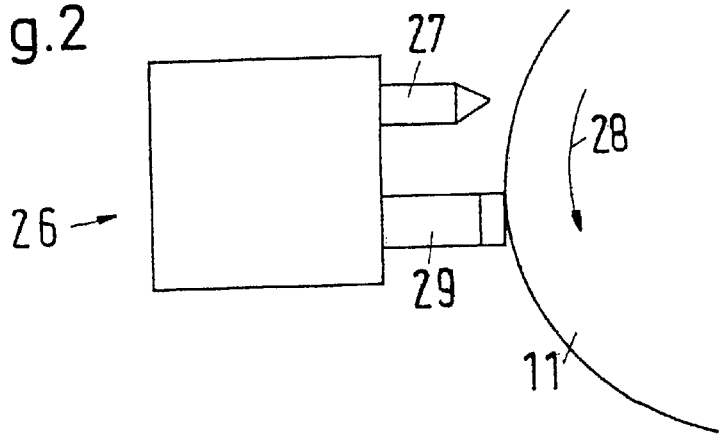
FIG. 2 schematically illustrates a finishing medium application device according to the invention.

To diminish this problem, the present invention provides that each soft roll positioned behind changeover nip 18 relative to a web travel direction, i.e., rolls 7, 9, and 11, is provided with a finishing medium application device 24, 25, and 26. An exemplary illustration of finishing medium application device 26 is shown in an enlarged manner in FIG. 2.

Finishing medium application device 26 has as spray nozzle (dispenser) 27 that sprays a liquid finishing medium, e.g., a liquid silicon rubber, in the form of a fine mist onto the surface of roll 11, which is rotating in the direction of an arrow 28. As roll 11 is warm due to operation of the calender, the finishing medium dries relatively quickly. Behind spraying nozzle 27 in the rotational direction 28, a smoothing device 29 is arranged that smooths the dried finishing medium, i.e., polishes it again in a manner of speaking.

Instead of the above-mentioned silicon rubber, other finishing media, preferably synthetic, can be used to give the surface of rolls 7, 9, and 11 an extremely smooth surface. For example, a hard wax containing TEFLON™ (polytetrafluoroethylene) can also be used as the finishing medium, as is principally known from polishing vehicle bodies. The roughness of these surfaces is thus practically adapted to the roughness of the hard rolls 3, 5, 8, and 10. In the exemplary embodiment shown, in which finishing medium application devices 24, 25, and 26 can apply finishing medium to the rolls 7, 9, and 11 during operation, the layer of finishing medium need not have any "stability," i.e., it can wear off relatively quickly because it is constantly renewed. Under certain conditions, it can also be sufficient to apply the finishing medium only in intervals, e.g., when a certain wear has been ascertained. This can be accomplished using sensors 30. A condition for such an application of finishing medium is that the finishing medium either dries so quickly that a "contamination" of paper web 13 does not occur or that the finishing medium is compatible to paper web 13, i.e., does not cause any decrease in quality.

In another manner of operation, the finishing medium can always be applied when an interruption in operation occurs. Such an interruption can be forced, e.g., by a tear of the paper web. In this case, the torn paper web must be removed from the calender anyway. During this time, finishing medium can be applied to soft rolls 7, 9, and 11. In this event, the service life of the finishing medium must be somewhat longer.

Especially in the case of calenders that work offline, it is attractive to always apply the finishing medium when an interruption of the normal paper web glazing is necessary, for example during a change of the paper reels.

However, it is also more favorable under certain circumstances to apply the finishing medium only when the calender must be stopped for maintenance work. Naturally, all manners of application can be combined with one another.

Finally, the finishing medium can also be supplied with the aid of the paper web, i.e., a patina can be artificially supplied that is constantly renewed.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for operating a calender, the calender having at least one hard roll and at least one soft roll with an elastic surface arranged to form at least one nip, the process comprising:

applying a finish on the elastic surface of the soft roll while the at least one soft roll is located in an installed position in the calender.

2. The process in accordance with claim 1, wherein the finish is provided by applying a liquid finishing medium to the elastic surface.

3. The process in accordance with claim 2, wherein the finishing medium is applied to the elastic surface while the elastic surface is warm.

4. The process in accordance with claim 1, wherein the finish is polished.

5. The process in accordance with claim 1, wherein operation of the calender includes maintenance pauses for the purpose of maintenance, and the finish is applied outside of the maintenance pauses.

6. The process in accordance with claim 5, wherein the finish is applied during the maintenance pauses.

7. The process in accordance with claim 5, wherein the finish is continuously applied during operation of the calender.

8. The process in accordance with claim 7, wherein the finish is applied via a material web to be calendered in the nip.

9. The process in accordance with claim 1, wherein operation of the calender includes maintenance pauses for the purpose of maintenance, and the finish is applied during maintenance pauses.

10. The process in accordance with claim 1, wherein the at least one soft roll includes a plurality of soft rolls and a predetermined number of the soft rolls are provided with a finish.

11. The process in accordance with claim 10, wherein the calender further includes a changeover nip formed by two similar type rolls, and the predetermined number of soft rolls are arranged after the changeover to nip relative the web travel direction.

12. The process in accordance with claim 11, wherein the two similar type rolls comprise two soft rolls.

13. The process in accordance with claim 1, wherein the finish is provided by spraying a finishing medium onto the elastic surface.

14. The process in accordance with claim 13, wherein the finishing medium comprises a liquid silicon rubber.

15. The process in accordance with claim 13, wherein the finishing medium comprises a hard wax containing polytetrafluoroethylene.

16. The process in accordance with claim 13, wherein the finish provided on the elastic surface forms a more smooth surface than the elastic surface without the finish.

17. The process in accordance with claim 13, wherein the finishing medium is compatible with the material web to avoid any decrease in web quality.

18. The process in accordance with claim 13, wherein the finishing medium dries between an application point and a material web contact point.

19. The process in accordance with claim 1, further comprising monitoring the finished elastic surface for wear, and, upon finding at least a certain amount of wear, refinishing the finished elastic surface.

20. The process in accordance with claim 1, wherein the applied finish wears down over time, and the process further comprises:

reapplying the finish on the elastic surface of the soft roll while the at least one soft roll is located in its installed position in the calender.

21. A calender comprising:

a hard roll;

a soft roll with an elastic surface, said hard roll and said soft roll being arranged to form at least one nip; and a finishing medium application device positioned adjacent said soft roll while said soft roll is in an installed position in said calender.

22. The calender in accordance with claim 21, said finishing medium application device comprising a dispenser for dispensing finishing media.

23. The calender in accordance with claim 22, wherein said finishing media is one of a liquid or a pasty medium.

24. The calender in accordance with claim 21, said finishing medium application device comprising a smoothing device arranged to follow the dispenser in a rotational direction of said soft roll.

25. The calender in accordance with claim 21, wherein said finishing medium application device is structured and arranged to apply a finishing medium to a surface of said at least one soft roll that wears down over time, and the apparatus further comprises a device for actuating the finishing medium application device to apply and reapply the finishing medium to said surface of said at least one soft roll while it is located in its installed position in the calender.

26. A calender comprising:

a hard roll;

a soft roll with an elastic surface, said hard roll and said soft roll being arranged to form at least one nip; and a finishing medium application device positioned adjacent said soft roll;

additional hard rolls;

additional soft rolls with elastic surfaces, said additional hard rolls and additional soft rolls being arranged to form additional nips;

at least two similar type rolls being arranged to form a changeover nip; and additional finishing medium application devices positioned adjacent each soft roll located behind said changeover nip in a calendering direction.

27. The calender in accordance with claim 26, wherein the at least two similar type rolls comprise two soft rolls.

28. The calender in accordance with claim 21, wherein said finishing medium application device comprises a nozzle for spraying finishing media onto the elastic surface.

29. The calender in accordance with claim 28, wherein said finishing media comprises a liquid silicon rubber.

30. The calender in accordance with claim 28, wherein said finishing media comprises a hard wax containing polytetrafluoroethylene.

31. The calender in accordance with claim 28, wherein said finishing medium application device is arranged to provide a finish on the elastic surface to form a more smooth surface than said elastic surface without the finish.

32. The calender in accordance with claim 28, wherein said finishing media is compatible with the material web to avoid any decrease in web quality.

33. A calender comprising:

a hard roll;

a soft roll with an elastic surface, said hard roll and said soft roll being arranged to form at least one nip; and a finishing medium application device positioned adjacent said soft roll, wherein said finishing medium application device comprises a nozzle for spraying finishing media onto the elastic surface, and wherein said finishing media dries between an application point and a material web contact point.

34. A calender comprising:

a hard roll;

a soft roll with an elastic surface, said hard roll and said soft roll being arranged to form at least one nip;

a finishing medium application device positioned adjacent said soft roll; and a wear sensor arranged to monitor the finished elastic surface for wear.

35. The calender in accordance with claim 34, wherein said wear sensor is coupled to said finishing medium application device such that, upon finding at least a certain amount of wear, said finishing medium application device refinishes the finished elastic surface.

36. A calender comprising:

a first roll stack comprising at least one first hard roll and at least one first soft roll;

a second roll stack comprising at least one second hard roll and at least one second soft roll;

wherein said at least one first hard roll and said at least one first soft roll are arranged to form at least one first nip and said at least one second hard roll and said at least one second soft roll are arranged to form at least one second nip;

at least two similar type rolls are arranged to form a changeover nip;

said changeover nip being positioned between said first roll stack and said second roll stack, wherein said second roll stack is arranged after said first roll stack in a calendering direction;

a finishing medium application device arranged adjacent said at least one second soft roll.

37. The calender in accordance with claim 36, wherein said at least one second soft roll comprises a plurality of second soft rolls, and a finishing medium application device is arranged adjacent each of said plurality of second soft rolls.

38. A process for operating a calender that includes a first roll stack comprising at least one first hard roll and at least one first soft roll, and a second roll stack comprising at least one second hard roll and at least one second soft roll, such that the at least one first hard roll and the at least one first soft roll are arranged to form at least one first nip and the at least one second hard roll and the at least one second soft roll are arranged to form at least one second nip, at least two similar type rolls are arranged to form a changeover nip, which is positioned between the first roll stack and the second roll stack, such that the second roll stack is arranged after the first roll stack in a calendering direction, said process comprising:

applying finishing medium to a surface of the at least one second soft roll while the at least one soft roll is in an installed position in the calender.

39. The process in accordance with claim 38, further comprising smoothing the applied finishing medium.

40. The process in accordance with claim 38, wherein the at least one second soft roll comprises a plurality of second soft rolls, and the process further comprises:

applying finishing medium to each of the plurality of second soft rolls.

41. The process in accordance with claim 40, further comprising smoothing the applied finishing medium on each of the plurality of second soft rolls.

42. The process in accordance with claim 38, wherein the applied finish wears down over time, and the process further comprises:

reapplying the finish on the elastic surface of the soft roll while the at least one soft roll is located in its installed position in the calender.

* * * * *